United States Patent [19]

Zahn

[11] Patent Number: 4,625,337

[45] Date of Patent: Dec. 2, 1986

[54] SAFETY RAIN SUIT

[76] Inventor: Daniel P. Zahn, Rte. 1, Box 99, Lomira, Wis. 53048

[21] Appl. No.: 762,519

[22] Filed: Aug. 5, 1985

[51] Int. Cl.[4] ..... A41D 31/00

[52] U.S. Cl. ..... 2/82; 2/94; 2/247; 40/586

[58] Field of Search ..... 2/82, 94, 69, 69.5, 2/75, 80, 85, 87, 93, 96, 247, 249, 250, 199; 40/586

[56] References Cited

U.S. PATENT DOCUMENTS

| | | | |
|---|---|---|---|
| 929,240 | 7/1909 | Novoson | 2/199 X |
| 1,436,854 | 11/1922 | Brady | 40/586 |
| 2,803,829 | 8/1957 | Tscharner | 2/199 X |
| 2,821,035 | 1/1958 | Joseph | 40/586 |
| 3,076,206 | 2/1963 | Shaw et al. | 2/82 X |
| 3,111,680 | 11/1963 | Horowitz et al. | 2/82 X |
| 3,686,064 | 8/1972 | Bonnet et al. | 2/82 X |
| 3,829,995 | 8/1974 | Fakoury | 40/586 X |
| 4,034,417 | 7/1977 | Ellis | 2/82 X |
| 4,124,903 | 11/1978 | Shaw | 2/82 X |
| 4,389,801 | 6/1983 | Sharrock et al. | 40/586 X |
| 4,483,019 | 11/1984 | Spangrud | 2/82 X |

FOREIGN PATENT DOCUMENTS

| | | | |
|---|---|---|---|
| 1393465 | 2/1965 | France | 2/94 |
| 1583448 | 1/1981 | United Kingdom | 2/82 |
| 2089644 | 6/1982 | United Kingdom | 2/250 |

*Primary Examiner*—Louis K. Rimrodt
*Attorney, Agent, or Firm*—Donald Cayen

[57] ABSTRACT

A comfortable and waterproof rain suit is colored a safety blaze orange. The suit further includes a transparent hunting tag holder formed integrally with the suit jacket. The holder may be of a two piece or single piece construction. In both constructions, the tag holder includes a transparent panel that cooperates with the jacket to form a pocket for accepting the tag and a transparent flap for covering the pocket, thereby rendering the tag visible through the panel and flap.

4 Claims, 6 Drawing Figures

SAFETY RAIN SUIT

BACKGROUND OF THE INVENTION

1. Field of the Invention

This invention pertains to wearing apparel, and more particularly to rain apparel that combines convenience and safety features.

2. Description of the Prior Art

Outdoorsmen demand several characteristics of the clothing they wear in the field. Water resistance and light weight are of particular importance. In addition, hunters require that the clothing contribute to their safety. For that reason, red and orange colored hunting jackets and pants are widely used. However, red and orange colors are not available in rainproof hunting jackets and pants. Consequently, many hunters presently purchase a red or orange plastic poncho for wearing over their regular hunting clothes. Other options available to hunters include the use of separate safety garmemts, which may be somewhat similar to those shown in U.S. Pat. Nos. 2,342,005; 2,437,223; 3,047,875; and 4,017,908. Those options are unsatisfactory because they require the expense of an additional garment. Also, available plastic ponchos are bulky, noisy, and easily torn in use. The other mentioned safety items are inconvenient to hunters in addition to having the drawback of excessive cost.

Another clothing feature important to hunters is convenience with respect to the wearing of hunting tags. It is known to insert a hunting tag into a tag holder having at least one transparent side, and then pinning the holder to the back of the hunting jacket. That practice poses a serious disadvantage when applied to a rain jacket, because the pin holes destroy the integrity of the jacket material, thereby allowing the jacket to leak. Further, present pinned-on tag holders catch easily in bushes and tree branches, and they noisly crunch and bend when the hunter leans on a tree against the tag holder. Another example of a tag holder is shown in U.S. Pat. No. 1,436,854, but that device is expensive and cumbersome to use. Somewhat similar tags may be seen in U.S. Pat. Nos. 4,024,997 and 4,375,133, but they are generally unsatisfactory for wearing on a hunting jacket.

Thus, a need exists for a hunting rain suit that combines safety and convenient tag holding features.

SUMMARY OF THE INVENTION

In accordance with the present invention, a rain suit is provided that incorporates safety and convenience features in a combination heretofore unavailable. This is accomplished by manufacturing the rain suit with a transparent pocket formed integrally with an opaque safety colored suit material.

The suit material may generally be of known construction, as, for example, a two layered material. The inner layer may be moisture absorbing and comfortable to the feel, and the outer layer may be a tough, durable, and waterproof shell. The suit outer layer is dyed an opaque safety color, preferably blaze orange.

Further in accordance with the present invention, the safety rain suit includes a pocket created by a transparent hunting tag holder formed integrally with the suit. The holder may be bonded by an adhesive to the opaque suit material, or it may be sewn thereto. To protectively retain the hunting tag in the pocket, a transparent cover flap for covering the pocket opening is also formed integrally with the suit material. Thus, the hunting suit of the present invention combines a safety color, a transparent tag holder, and rain protection in a single garment.

Other features and advantages of the invention will become clear to one skilled in the art upon reading the detailed description.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
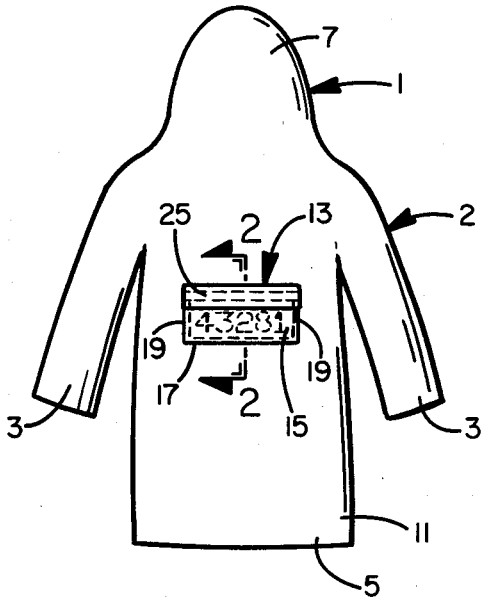
FIG. 1 is a back view of the safety rain suit of the present invention.

Referring to FIG. 1, a safety rain suit 1 is illustrated that includes the present invention. The safety suit is particularly useful to hunters, but it will be understood that the invention is not limited to sports applications.

The safety suit 1 includes a jacket 2 that is fabricated with the usual arms 3 and body portion 5. The jacket 2 preferably includes a hood 7. The jacket may be closed in front by a conventional zipper or snaps, not shown. The suit is contemplated to include pants of any desired design, such as with an elasticized waist or bib-type overalls, not illustrated in FIG. 1.

The suit 1 may be made from generally conventional materials. An especially suitable material is a laminate of a soft, flexible, and comfortable inner layer 9 covered with a durable and waterproof outer layer 11, FIG. 2. A suitable material for the inner layer 9 is a soft nylon fabric.

In accordance with the present invention, the outer waterproof layer 11 is comprised of an opaque high visibility safety colored material. The preferable safety color is blaze orange. That color is highly visible at great distances in typical outdoor conditions. The outer layer 11 is advantageously made as a shell of blaze orange polyvinyl chloride. A laminate of that material with the nylon fabric layer 9 results in a garment that is long-wearing, comfortable, waterproof, and safe. Accordingly, the blaze orange suit 1 of the present invention is especially suitable for hunting applications, particularly in states that specify by law that blaze orange clothing must be worn while hunting. In addition, the safety suit is ideal for wearing on the job by workers in hazardous occupations such as highway surveying and construction.

Figure 2:
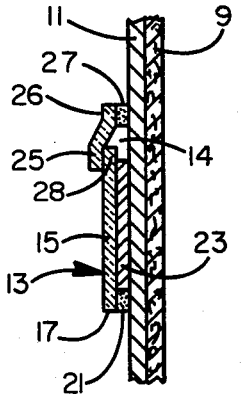
FIG. 2 is an enlarged sectional view taken along lines 2—2 FIG. 1.

Further in accordance with the present invention, the jacket 2 of the suit 1 is manufactured with a transparent hunting tag holder 13 formed integrally with the jacket. As shown in FIGS. 1 and 2, the tag holder 13 comprises a generally rectangular panel of material 15 that cooperates with the jacket 2 to form an open top pocket 14. The panel 15 is bonded at the bottom margin 17 and side margins 19 thereof to the jacket outer layer 11, usually at approximately the center of the jacket back. Bonding may be by strips of any suitable adhesive, as at 21 along lower margin 17, FIG. 2, and along the side margins 19, FIG. 1. Alternatively, the panel material 15 and jacket outer layer may be of materials that permit the panel material to be heat sealed to the outer layer along the panel margins 17 and 19. A suitable material for the panel 15 is a clear polyethylene. Thus, a hunting tag 23 inserted into the pocket 14 is visible through the clear material 15.

To cover the pocket 14 and protect the hunting tag 23, the tag holder 13 further comprises a flap 25. The flap 25 is made of the same transparent material as the rectangular panel of material 15. The flap may be bonded at the upper horizontal margin 26 thereof to the jacket layer 11 by a horizontal line of adhesive 27 in a manner substantially similar to the bonding of the panel 15 to the jacket. The flap overlaps the upper portion 28 of the panel 15. Accordingly, a hunting tag inserted in the tag holder is fully protected against loss and damage while being completely visible through the pocket and flap.

Figure 3:
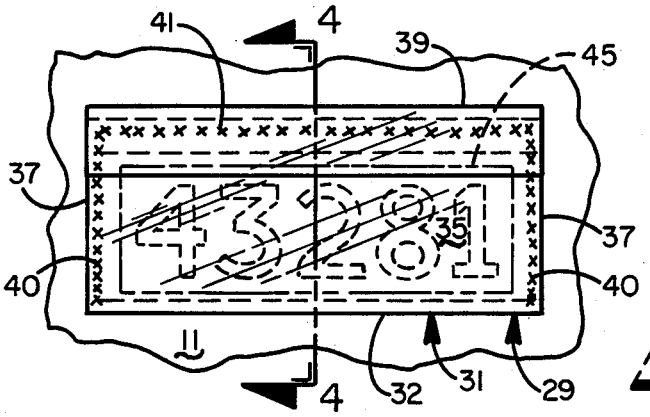
FIG. 3 is a back view of a modified embodiment of the present invention.
Figure 4:
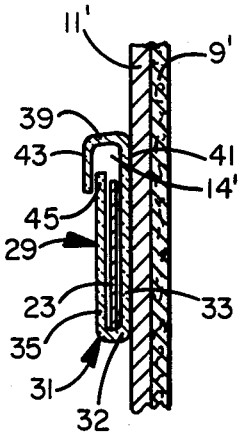
FIG. 4, is a sectional view taken along lines 4—4 of FIG. 3.

Referring to FIGS. 3 and 4, a modified tag holder 29 is illustrated. The tag holder 29 is composed of a single piece of transparent material 31. The material 31 is folded horizontally along a lower fold line 32 to create a back panel 33 and a front panel 35. The side margins 37 of the back and front panels 33 and 35, respectively, are secured to each other and to the jacket outer layer 11' by any suitable means. For example, the margins 37 may be bonded to each other and the margins of the inner panel 33 bonded to the layer 11' with an adhesive, not illustrated. Alternatively, the margins 37 of the material 31 may be sewn along vertical stitch lines 40. Consequently, an open top pocket 14' is created. Optionally, the upper margin of the back panel may be bonded or sewn along horizontal line 41. The transparent material 31 terminates in a flap 43 created by folding the back panel forwardly along horizontal fold line 39 so as to cover the top portion 45 of the front panel and thereby enclose the pocket 14' and hunting tag 23'. Thus, the hunting tag is fully protected but readily visible through the tag holder 29.

Figure 5:
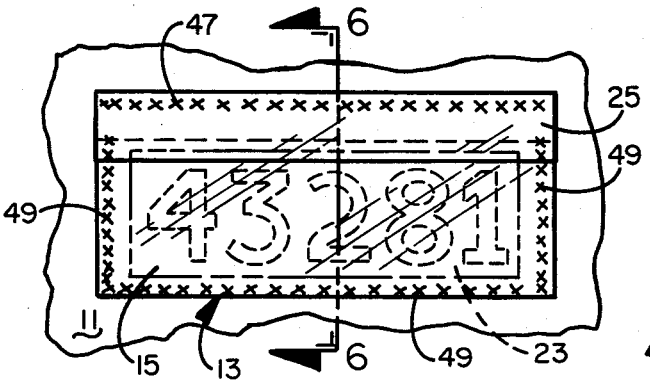
FIG. 5 is a back view similar to FIG. 3, but showing a further modification of the present invention.
Figure 6:
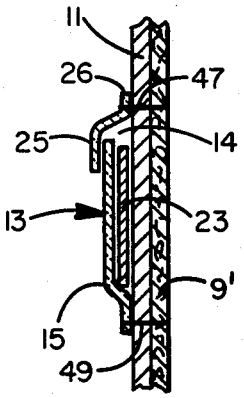
FIG. 6 is a sectional view taken along lines 6—6 of FIG. 5.

Turning to FIGS. 5 and 6, an alternative construction to the tag holder 13 of FIGS. 1 and 2 is illustrated. Rather than bonding the flap 25 and panel 15 with lines of adhesive 27 and 21, respectively, (FIGS. 1 and 2) the flap and front panel are sewn along stitch lines 47 and 49, respectively.

It will be appreciated that the tag holders 13 and 13' are not limited to use with jackets having a safety colored outer layer 11. On the contrary, the tag holders are equally useful with jackets made of low visibility camouflage or other desired designs. Further, the tag holders are not restricted to carrying hunting tags. Rather, a piece of paper or fabric of a bright color that contrasts with the jacket color may be inserted into the pockets 14 or 14'. The result is a break in the coloration of the jacket back, thereby tending to catch the eye of a nearby person. A yellow tag worn with the blaze orange suit is especially eye catching.

Thus, it is apparent that there has been provided, in accordance with the invention, a safety hunting suit that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A hunting suit comprising:

a. a jacket adapted to be worn by a person and manufactured from an opaque material, the jacket having an imperforate back; and b. a transparent hunting tag holder permanently bonded to the back of the jacket, the holder comprising an imperforate generally rectangular panel fabricated from a transparent material and permanently bonded at the side and bottom margins thereof to the jacket back to thereby cooperate with the jacket back to form an open top pocket integral with the jacket, and a generally rectangular imperforate flap fabricated from a flexible transparent material and permanently bonded along the upper margin thereof to the jacket back and overlapping the panel to cover the pocket open top, the flap being selectively foldable upwardly along the upper margin thereof to uncover the pocket open top, so that a hunting tag inserted in the pocket is visible through the transparent panel and flap.

2. A hunting suit comprising:

a. a jacket adapted to be worn by a hunter and made from an opaque material; and b. a transparent tag holder permanently bonded to the jacket back, the tag holder being formed from a single piece of imperforate flexible transparent material having a back panel in facing contact with the jacket back, a front panel joined to the back panel along a lower fold line therebetween, the front panel being folded upwardly over onto the back panel along the lower fold line, and a flap joined to the back panel along an upper fold line therebetween, the flap being selectively foldable downwardly over onto the front panel along the upper fold line and foldable upwardly along the upper fold line to be generally coplaner with the back panel, the front and back panels having respective side margins permanently bonded to each other and to the jacket back, so that the back and front panels cooperate to define a transparent open top pocket integral with the jacket and the transparent flap selectively covers and uncovers the pocket open top.

3. A safety rain suit comprising:

a. a jacket adapted to be worn by a hunter and made from a laminated material, the laminated material having an inner layer of comfortable fabric and an outer shell of waterproof safety pin visibility blaze orange material;

b. a generally rectangular imperforate panel of transparent material permanently bonded along the bottom and side margins thereof to the jacket back for cooperating with the jacket to create an open top pocket integral with the jacket; and c. a generally rectangular imperforate flap of transparent material permanently bonded along the upper margin thereof to the jacket back above the top margin of the rectangular panel and overlapping the top margin of the rectangular panel to cover the pocket, so that the rain suit is suitable for hunting and an object placed in the pocket is enclosed within the panel and flap and is visible through the transparent panel and flap.

4. A safety rain suit comprising:

a. a jacket adapted to being worn by a hunter and made from a laminated material, the laminated material having an inner layer of comfortable fabric and an outer shell of waterproof camouflage colored material;

b. a generally rectangular imperforate panel of transparent material permanently bonded along the bottom and side margins thereof to the jacket back for cooperating with the jacket to create an open top pocket integral with the jacket; and c. a generally rectangular imperforate flap of transparent material permanently bonded along the upper margin thereof to the jacket back above the top margin of the rectangular panel and overlapping the top margin of the rectangular panel to cover the pocket, so that the rain suit is suitable for hunting and an object placed in the pocket is enclosed within the panel and flap and is visible through the transparent panel and flap.

* * * * *